United States Patent [19]

Bunch

[11] Patent Number: 4,476,780

[45] Date of Patent: Oct. 16, 1984

[54] CUBE PRESS

[75] Inventor: Jesse C. Bunch, Silver Spring, Md.

[73] Assignee: Apollo Optics & Kinematics, Inc., Silver Spring, Md.

[21] Appl. No.: 563,811

[22] Filed: Dec. 21, 1983

[51] Int. Cl.[3] ..... B30B 7/00; B30B 15/04

[52] U.S. Cl. ..... 100/214; 100/245; 100/269 A; 100/295

[58] Field of Search ..... 100/269 R, 269 A, 214, 100/295, 240, 245; 425/417, 457; 254/93 AP; 269/22

[56] References Cited

U.S. PATENT DOCUMENTS 3,204,550 9/1965 Swiderski et al. ..... 100/295 X
3,410,202 11/1968 Chrubasik ..... 100/269 A X
4,213,384 7/1980 Telling ..... 100/295 X

FOREIGN PATENT DOCUMENTS 663088 12/1951 United Kingdom ..... 100/269 A

*Primary Examiner*—Billy J. Wilhite

*Attorney, Agent, or Firm*—Lane, Aitken & Kananen

[57] ABSTRACT

A fluid actuated press is defined by two interlinked box shaped members having open sides with the upper member fixed and the lower member moveable with respect to the upper member. The top wall of the moveable member is positioned between the top and bottom walls of the fixed member and the space between the top wall of the moveable member and the bottom wall of the fixed member defines an expandable fluid chamber to receive pressurized fluid. When pressurized fluid is introduced into the chamber it expands the fluid chamber driving the moveable member in an upward direction toward the top wall of the fixed member and to apply a compressive force to a work piece positioned between the upper wall of the fixed member and the top wall of the moveable member. The walls of the boxed shaped member are reinforced with parallel bars which are notched or provided with tabs at the ends thereof to interlock with the bars of the adjacent connecting wall to oppose relative outward movement.

12 Claims, 10 Drawing Figures

CUBE PRESS

This invention relates to fluid actuated presses such as a hydraulic press.

In a conventional hydraulic press, a hydraulic cylinder is used to drive a ram, usually in a vertically downward direction, toward a supporting surface on which a work piece is supported. In large presses the mounting structure for the ram is massive because it has to withstand and transmit the large forces applied by the ram against the work piece.

The object of the present invention is to provide a press which, for the same performance in terms of the amount of force that the press will apply to a work piece, requires substantially less materials, is substantially lighter, and is substantially less expensive to manufacture than the presses of prior art.

In accordance with the present invention, the press comprises two interlinked box shaped members having open sides, with the upper member being fixed and the lower member being moveable with respect to the upper member. The two box shaped members are linked in that the top wall of the moveable member is positioned between the top and bottom walls of the fixed member. The space between the bottom wall of the fixed member and the top wall of the moveable member defines a fluid chamber arranged to receive pressurized fluid, such as hydraulic fluid, so that when pressurized fluid is introduced into the chamber it expands the fluid chamber by driving the moveable member in an upward direction. As the moveable member is moved upwardly under the force of the pressurized fluid in the expanding chamber, compressive force will be applied to a work piece positioned between the top wall of the moveable member and the top wall of the fixed member. With this press construction, the same materials are employed to define the expanding fluid chamber as well as transmit the reaction to the compressive force applied to the work piece, and the working area of the pressurized fluid moving the moveable member is maximized. As a result the amount of material required to produce a given compressive force against a work piece is substantially reduced.

In accordance with a further aspect of the invention, the sides of the two box shaped members are reinforced with bars, which extend parallel to the open sides of the box shaped members and which are notched or provided with tabs at the ends thereof in order to withstand shearing forces at the corners of the bars.

Further objects and advantages of the present invention will become readily apparent from the detailed description of the preferred embodiments when considered in conjunction with the drawings.

DESCRIPTION OF THE PREFERRED EMBODIMENT

Figure 1:
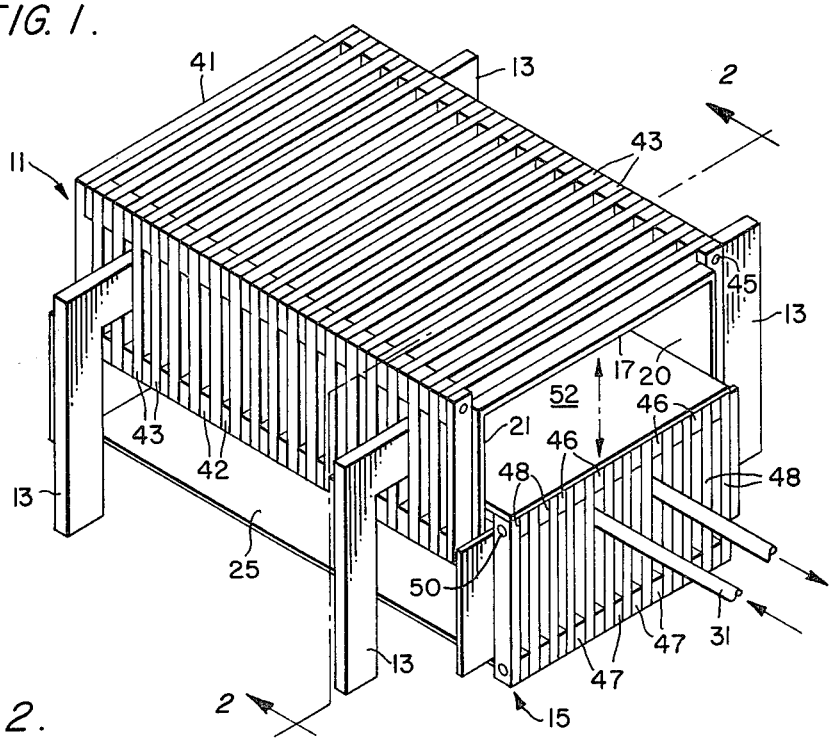
FIG. 1 is a perspective view of one embodiment of the press in accordance with the present invention.
Figure 4:
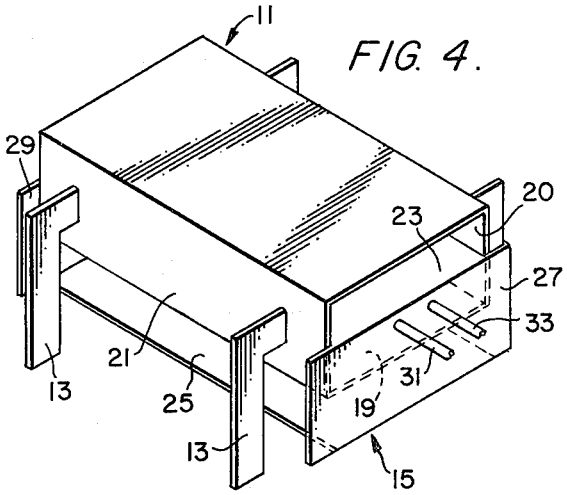
FIG. 4 is a schematic illustration of the press shown to illustrate the principles of operation of the press.

As shown in FIG. 1, the press of the present invention comprises an upper box shaped member 11 supported on legs 13 and a lower moveable box shaped member 15. The operation and structure of the press can be understood by first considering the schematic illustration shown in FIG. 4 in which the supporting parallel bars have been omitted for purposes of simplifying the illustration. As shown in FIG. 4, the upper fixed member 11 is in the shape of a cube or rectangular prism with two opposite side walls removed so as to define an open ended box shaped structure. The upper fixed member 11 comprises a top wall 17, a bottom wall 19 parallel to the wall 17, a side wall 20, and side wall 21 parallel to the sidewall 20. The moveable member 15 comprises a top wall 23 positioned between the walls 17 and 19 of the fixed member 11, a bottom wall 25 parallel to the wall 23 and positioned beneath the bottom wall 19 of the upper member 11, and two side walls 27 and 29 parallel to each other and extending between the top wall 23 and the bottom wall 25. The walls 17, 19, 20, and 21 of the upper member 11 all join each other at right angles to define a box shaped structure or in other words a structure generally in the shape of a rectangular prism. Similarly the walls of the moveable member 15 all join each other at right angles to also define a box shaped member or a member which is in the shape of a rectangular prism, except that the side walls 27 and 29 extend out beyond the dimensions of the walls 23 and 25 for reasons which will be explained below. The side edges of the top wall 23 of the moveable member 15 at the open sides of the member 15 make a sliding fit with the inner surfaces of the side walls 20 and 21 of the fixed member 11 and the side edges of the bottom wall 19 of the fixed member 11 at the open sides of the fixed member 11 make a sliding fit with the inner surface of the side walls 27 and 29 of the moveable member 15. The space between the top wall 23 and the bottom wall 19 defines a fluid chamber in a shape of a rectangular prism and fluid conduits 31 and 33 are provided mounted in wall 27 and leading into the fluid chamber for introducing fluid under pressure into the fluid chamber and for withdrawing fluid from the chamber. The conduits 31 and 33 are connected to a source of fluid pressure. In the preferred embodiment the press is a hydraulic press and the source of fluid pressure would be a hydraulic pump, but it is contemplated that the press could also be operated pneumatically, in which case air under pressure introduced into the fluid chamber between the wall 23 and the wall 19. The end edges of the sidewalls 20 and 21 make a sliding fit with the sidewalls 27 and 29 where they extend beyond the walls 20 and 21. The extensions of the walls 27 and 29 in sliding engagement with the end edges of the sidewalls 20 and 21 make it easier to contain pressurized fluid in the chamber between the walls 19 and 23 than if the walls 27 and 29 ended at the walls 20 and 21.

When the fluid under pressure is introduced into the chamber between the top wall 23 of the moveable member and the bottom wall 19 of the fixed member, the fluid expands the fluid chamber by moving the moveable member upwardly so that the wall 23 moves toward the wall 17. As a result a work piece placed between the wall 23 and a wall 17 will be compressed.

It will be noted that the fluid under pressure moving the moveable member acts against the interior bottom surface of the wall 23 which is substantially the same area as the working surface area of the press and the fluid pressure is applied directly to the opposite side of the wall which exerts the force on the work piece. As a result the fluid pressure in the press is efficiently converted into a force applied to the work piece. In addition it will be noted that the reaction to the force applied to the work piece is borne by the side walls 20 and 21, which are also used to define and contain the fluid chamber which expands to apply the force of the work piece. As a result of these features, the press schematically illustrated in FIG. 4 can be made with less materials, less expensively and much lighter in weight, and it can generate the same working force as much larger, heavier, and more expensive conventional presses.

Figure 2:
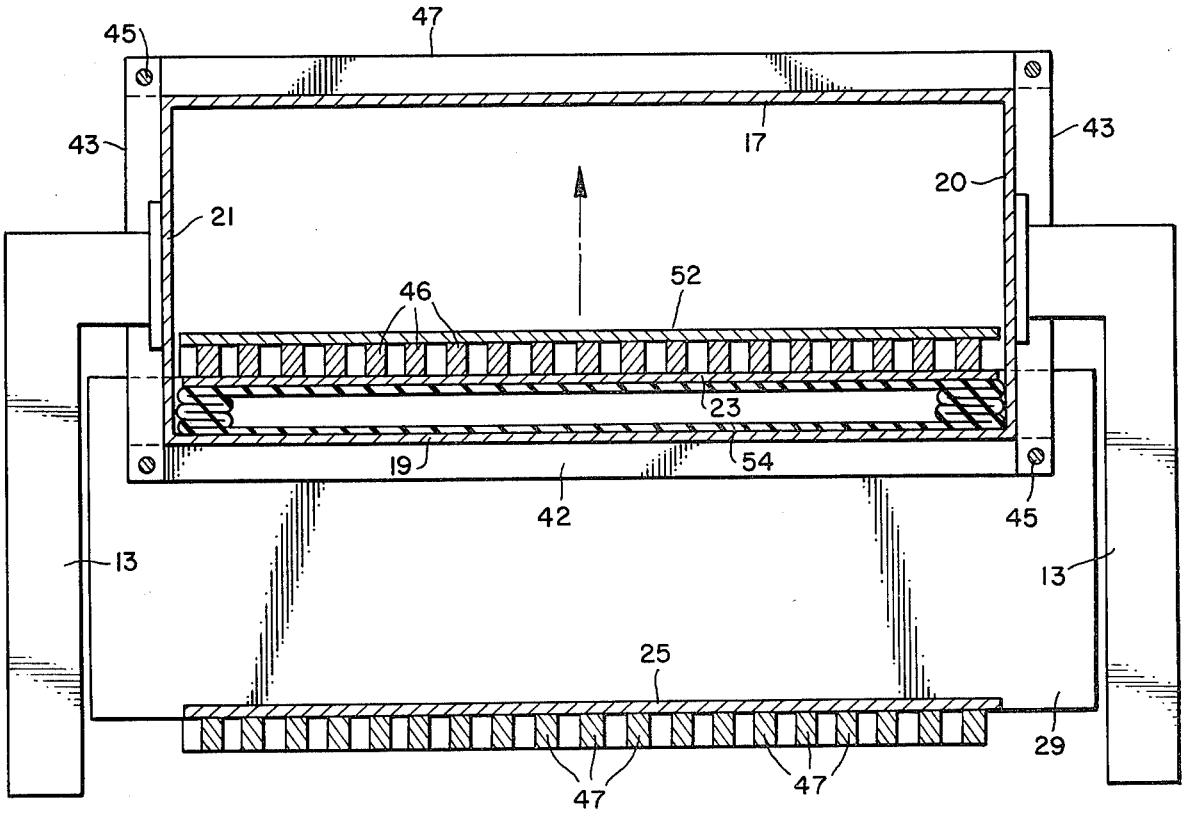
FIG. 2 is a sectional view in elevation of the press shown in FIG. 1 taken along line 2—2 with the moveable member of the press in a lower position.
Figure 3:
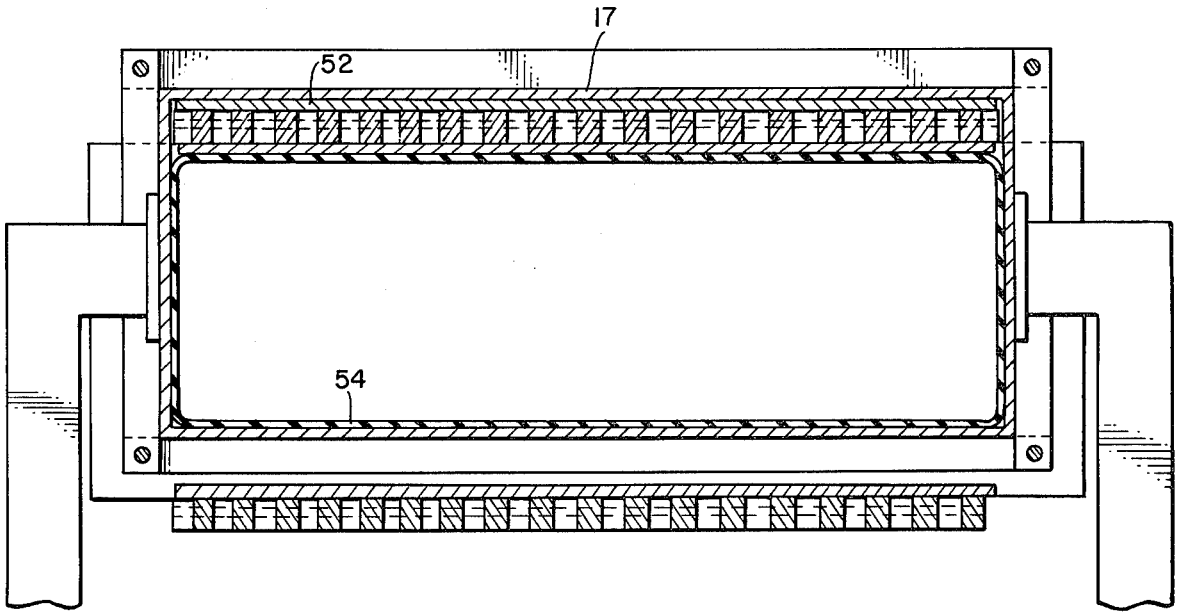
FIG. 3 is the same sectional view as FIG. 2 of the press shown in FIG. 1 but with the moveable member in the upper position.

In the preferred embodiment of the invention as shown in FIGS. 1 through 3, the upper box shaped member 11 is reinforced by parallel bars 41, 42, and 43 extending around the box shaped member and overlapping at the corners of the box shaped member. The bars 41 extend parallel to one another across the top wall 17 and parallel to the edges of the top wall 17 at the open end of the box shaped member 11. Bars 41 are above the top surface of the top wall 17 and are evenly spaced from one another across the length of top wall 17. In a similar manner bars 42 extend across and reinforce the bottom wall 19. Reinforcing bars 43 are arranged vertically in a similar manner with respect to the sidewalls 20 and 21 to reinforce the side walls. The bars 41 through 43 extend beyond the corners at the intersections of the top and side walls 17, 19, 20, and 21 and are interleaved with one another. The bars fit with one another in an interlocking structure to be described in more detail below. Pins 45 extend through the overlapping ends of the bars 41 through 43 to hold the bars in an assembled rectangular array extending around the box shaped member 11. In a similar manner bars 46 through 48 extend around and reinforce the walls of the lower box shaped member 15 with the bars 46 and 47 extending across and reinforcing the top and bottom walls 23 and 25 respectively and the bars 48 extending vertically to support the side walls 27 and 29. As in the case of the fixed upper member, the bars 46 through 48 are held in an assembled position where they overlap by pins 45 and have an interlocking structure identical to that of the interlocking structure of the bars 41 through 43. To provide a planar working surface, a steel plate 52 is mounted on the top of the bars 46 and the bars 46 are sandwiched between the plate 52 and the top wall 23 of the lower box shaped member 15. Within the fluid chamber defined by the top wall 23 of the moveable lower member 15, the bottom wall 19 of the fixed upper member 11, and the side walls 29 and 27 of the lower member 15 and the side walls 20 and 21 of the upper member 11 is a hydraulic bellows 54 to make the chamber fluid tight. When hydraulic fluid is introduced into the bellows 54 by means of hydraulic line 31, the bellows will expand moving the wall 23 and therefore the plate 52 toward the top wall 17 of the upper member 11 to compress any work piece placed on the plate 52 between the plate 52 and the wall 17. FIG. 3 shows the hydraulic bellows 54 fully extended with the plate 52 pushed all the way against the upper wall 17 of the upper box shaped member 11.

Figure 5:
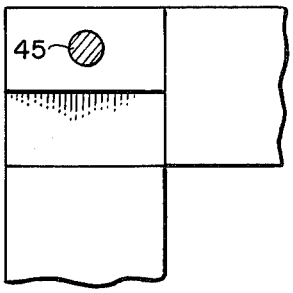
FIG. 5 is an enlarged sectional view taken parallel to the longitudinal dimension of the supporting bars and illustrating how the supporting bars interlock at the corners of one of the box shaped members.
Figure 6:
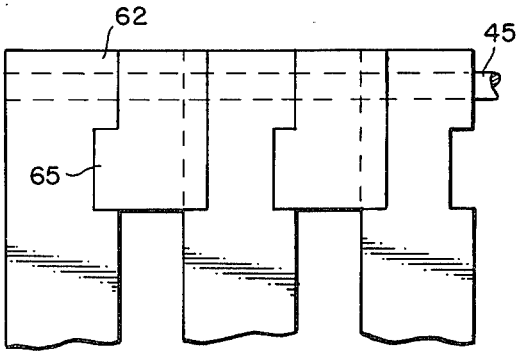
FIG. 6 is an enlarged view in elevation taken orthogonally to the view of FIG. 5 and showing how the supporting bars interlock at the corners of one of the box shaped members.
Figure 7:
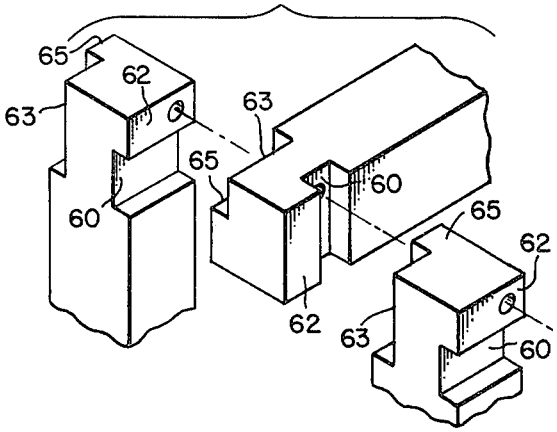
FIG. 7 is an exploded view in perspective further illustrating the details of the notched structure supporting bars at one corner for the press in FIG. 1.

The ends of the bars 41 through 43 and 46 through 48 are provided with an interlocking structure at the corners where they overlap to maximize the ability to the structure to withstand the large shearing forces that will be generated at these corners when the press is operated. The details of this interlocking structure are shown in FIGS. 5 through 7 and best can be understood from FIG. 7 which shows three overlapping bars in an exploded view with the assembly pin holding the bars together removed. As shown in FIG. 7 each bar is provided in one overlapping face of the bar with a rectangular transverse groove 60 leaving a rectangular projection 62 defined at the end of the bar of the same size as the groove 60. The face of the bar on the opposite side from the groove 60 is provided with a rectangular recess 63 defined in the corner of the bar and having a longitudinal dimension parallel to the longitudinal dimension of the bar and leaving a rectangular projection 65 on the opposite corner of the overlapping face. The overlapping recesses 60 and 63 are shaped and sized so that when the bars are assembled, the rectangular projections 62 of each bar will fit within a rectangular recess 63 in an adjacent bar and the rectangular projection 65 will fit within a rectangular groove 60 in an adjacent bar. This structure is interlocking against relative outward movement between adjacent overlapping bars. The particular interlocking structure maximizes the resistance to the large shearing stresses that will be generated at the overlapping corners of the bar when the press is operated on a work piece and forces are applied to the bars tending to cause the bars to separate from one another by moving outwardly from the box shaped member of which the bars are a part.

Figure 8:
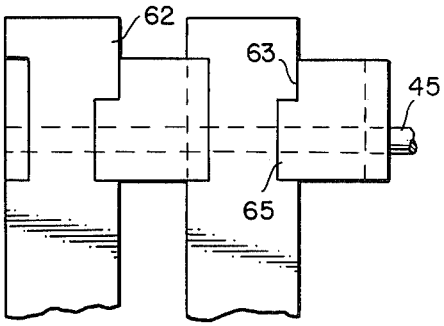
FIG. 8 is a view in elevation illustrating an alternative embodiment of a notched interlocking structure for the bars at the corners of the box shaped members.

FIG. 8 illustrates a modified interlocking structure for the bars which is similar to that shown in FIG. 5 through 7 except that the bars are arranged to overlap at an area spaced from their ends so that the rectangular projections 62 have an increased size by making their dimension parallel to the longitudinal dimension of the bars larger thus making the cross sectional area of the projection which is subjected to shearing stress of increased size. In addition the rectangular projection 65 is increased in size by decreasing the size of the recess 63. By making the projections of which are subjected to the shearing stress increased in size in this manner, the strength of the interlocking structure is increased.

Figure 9:
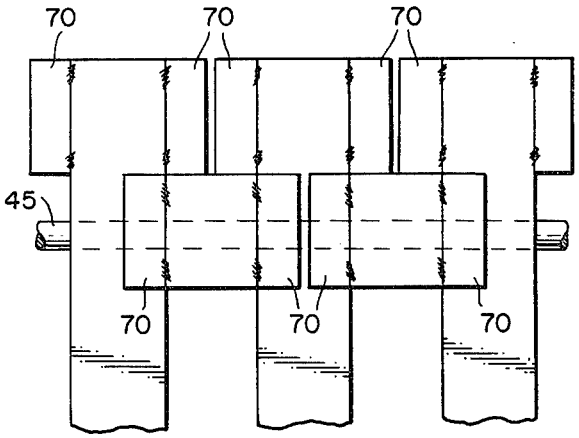
FIG. 9 is a view in elevation showing another alternative embodiment of the interlocking structure of the supporting bars at the corners of the box shaped members.
Figure 10:
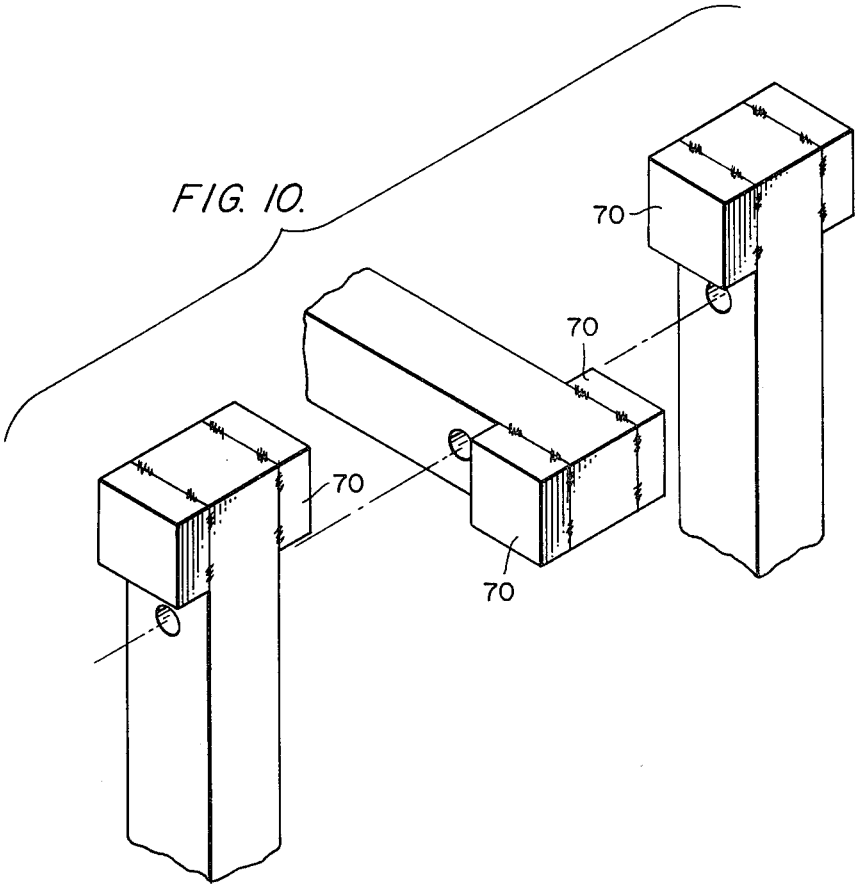
FIG. 10 is an exploded view to further illustrate how the bars in the embodiment of FIG. 9 interlock at the corners of the box shaped members.

FIGS. 9 and 10 illustrate still another embodiment for the interlocking structure at the corners of the bars. In the embodiment of FIG. 9, the bars are arranged to overlap with their ends extending beyond the area where the bars overlap and on the extended portions, rectangular blocks 70 are welded on the faces of the bars which face each other. These rectangular blocks will engage the side surfaces of the adjacent bars and the engagement of the blocks 70 with the side surfaces of the bars will provide the resistance of the structure to the tendency of the adjacent bars to move outwardly relative to one another. The welding of the blocks 70 to the bars may be achieved by using a large spot weld or multiple small spot welds or by welding the entire surface area of the block to the bar by means of explosive welding. Alternatively, adhesive bonding of the blocks 70 can be employed. In this arrangement it will be noted that the pin which holds the assembly of the bars together passes through an unaltered portion of each bar thus minimizing any weakening effect caused by the forming of the pin channel through each of the bars.

The above described press is capable of generating substantially increased compressive force relative to the size, weight and cost of the press compared with the conventional presses of the prior art. The above-description is a preferred embodiment of the invention and many modifications may be made thereto without departing from the spirit and scope of the invention, which is defined in the appended claims.

I claim:

1. A press comprising a first member having a first and second end walls on opposite sides of said first member, and side walls on opposite sides of said first member and connected to and joining the end walls of said first member and leaving two opposite sides of said first member open, a second member moveable with respect to said first member and having an end wall positioned within said first member and shaped and positioned so that two opposite edges thereof make a sliding fit with the inside faces of the side walls of said first member, said second member having side walls connected to the end wall of said second member and shaped and arranged so that the inside faces thereof make a sliding fit with the opposite edges of said first end wall of said first member, the first end wall of said first member, said end wall of said second member and said side walls defining a chamber between the end wall of said second member and the first end wall of said first member, and means to introduce fluid under pressure into said chamber to cause said chamber to expand by causing said second member to move toward the second end wall of said first member.

2. A press as recited in claim 1 wherein there is provided means to connect the side walls of said second member together on the opposite side of the first end wall of said first member from said end wall of said second member.

3. A press as recited as in claim 2 wherein said means connecting the side walls of said second member together comprises a second end wall of said second member on the opposite side of said first end wall of said first member from the first mentioned end wall of said second member.

4. A press as recited in claim 2 wherein said first and second members comprise interlinking rectangular structures.

5. A press as recited in claim 2 wherein said side walls, said end walls and said means to connect include parallel reinforcing bars, the reinforcing bars of said first member extending parallel to the side walls of said second member and the reinforcing bars of said second member extending parallel to the side walls of said first member.

6. A press as recited in claim 5 wherein the reinforcing bars of each member interconnect at corners of said member and are provided with interlocking structure where the bars interconnect, said interlocking structure comprising means for the bars of each member to oppose relative motion between the reinforcing bars outwardly from such member.

7. A press as recited in claim 6 wherein said interlocking structure comprises recesses and projections defined in the ends of said bars which fit with the recesses and projections defined in adjacent bars of adjacent connecting walls.

8. A press as recited in claim 6 wherein said interlocking structure comprises blocks fixed to the ends of said bars and engaging the side edges of the bars of the adjacent connecting walls.

9. A press as recited in claim 1 wherein the end walls and side walls of said first member define a rectangular structure.

10. A press as recited in claim 1 wherein means are provided to remove fluid from said chamber to permit said second member to move toward the first end wall of said first member and said chamber to contract.

11. A press as recited in claim 10 wherein said chamber includes a bellows to contain hydraulic fluid introduced under pressure into said chamber.

12. A press as recited in claim 1 wherein said first member is fixed, said first end wall is a bottom wall said second end wall is a top wall and said second member moves upwardly towards said second end wall when fluid under pressure is introduced into said chamber to expand said chamber.

* * * * *